United States Patent [19]

Luchetta

[11] 3,954,316

[45] May 4, 1976

[54] ELECTRICAL APPARATUS AND METHOD FOR REDUCING POWER CONSUMPTION OF A FLUORESCENT LAMP SYSTEM

[75] Inventor: Julius Frank Luchetta, Elmhurst, Ill.

[73] Assignee: Litton Systems, Inc., Bellwood, Ill.

[22] Filed: Jan. 8, 1975

[21] Appl. No.: 539,355

[52] U.S. Cl. ..... 315/96; 315/97; 315/187; 315/228

[51] Int. Cl.[2] ..... H05B 41/14

[58] Field of Search ..... 315/96, 97, 185 R, 187, 315/227 R, 228, 94, 98, 105, 177, 176

[56] References Cited

UNITED STATES PATENTS

| | | | |
|---|---|---|---|
| 2,864,035 | 12/1958 | Davis | 315/98 X |
| 3,089,981 | 5/1963 | Roesel, Jr. | 315/98 |
| 3,629,648 | 12/1971 | Brown et al. | 315/105 X |
| 3,754,160 | 8/1973 | Jensen | 315/97 |

*Primary Examiner*—R. V. Rolinec
*Assistant Examiner*—Darwin R. Hostetter
*Attorney, Agent, or Firm*—Ronald M. Goldman

[57] ABSTRACT

An attachment is provided for inclusion in a two-lamp rapid-start type fluorescent lamp and encapsulated ballast transformer combination to reduce the electrical power consumption thereof, comprising an isolation transformer and a capacitor. The isolation transformer is connected in circuit between the secondary heater winding at the electrical leads that extend from the encapsulated ballast and the first heater terminals of the first lamp, and the capacitor is connected in circuit between the primary and secondary of the isolation transformer.

7 Claims, 2 Drawing Figures

ELECTRICAL APPARATUS AND METHOD FOR REDUCING POWER CONSUMPTION OF A FLUORESCENT LAMP SYSTEM

BACKGROUND OF THE INVENTION

This invention relates to electrical apparatus for starting and operating fluorescent lamps with reduced power consumption and, more particularly, to an attachment for an existing two-lamp rapid-start fluorescent lamp and ballast transformer lighting system which reduces the power consumption of the lamp system and to the novel combination so formed.

Numerous stores, offices and homes employ fluorescent lighting fixtures to provide desired illumination. Many of these fluorescent lamp fixtures employ the long cylindrical fluorescent type lamp known as the "rapid-start" type which contains heater filaments. Such lamps are operated in the fixture in groups of two, electrically connected in series effectively and operated from a high reactance transformer and capacitor combination, sometimes referred to as a "ballast," which provides the high starting voltages required by these fluorescent type lamps, the current limited lower operating voltages and the filament current and voltages. By design the lamps and the ballasts are matched together so that the lamps operate at maximum efficiency and hence, by design, a certain electrical current effectively flows through the lamp circuit to provide full lamp brightness. Electrical power is obtained via the building wiring from the local power company or utility and is supplied to the ballast input.

Presently a conservation move exists to reduce electrical consumption. In particular, some electrical utilities have been requiring consumers, such as the industrial, store and factory users, to reduce electrical power consumption by 15 percent or more or suffer a financial penalty or, possibly, cut-off of electrical service. To meet this requirement, business has resorted to many expedients resulting in some such savings with unavoidable individual inconvenience. Thus the hot water has been turned off; the temperatures for air conditioning are fixed for a higher than normal temperature; heating is limited; and, most relevant to the present invention, the lights are "turned off."

If each fluorescent lamp fixture were controlled by a single associated wall-mounted "on-off" switch and only selected lamp units were turned off, the practice of that expedient and the concurrent power savings is simple. In practice however, long "banks" of fixtures are controlled by a single "on-off" switch. Hence if the switch is turned to "off" an entire area may be placed in darkness. Obviously that condition is impractical in a business or factory.

Instead the procedure which has been adopted is the simple expedient of removing alternate pairs of the fluorescent lamps from the overhead fixtures. In a sense this cuts down the illumination in an area to one-half or some other fraction less than previously obtained with all lamps in operation. Thus although lighting is reduced, the area remains sufficiently illuminated to permit persons to continue performance of their duties.

In the example given, although the amount of illumination is reduced in half by removal of half of the lamps, the electrical consumption it is found is not reduced in half as logic might suggest. What is overlooked in the practice of this expedient is although the "electrical load," i.e., the fluorescent lamps, is removed, the ballast transformer remains connected in circuit in the electrical power system. Consequently the primary of the ballast remains in the electrical system as an inductively reactive electrical load. As is known to those skilled in the art, the magnetic hysteresis action inherent in the iron core of the transformer consumes some minor amount of power, technically known as "core loss." In addition, the reactive current supplied the ballast transformer is of a significant level.

As is familiar to those skilled in the art, large reactive currents flowing in the on-premises electrical system lines create resistive heating losses therein and thus waste electrical energy. Not only is this undesirable on the premises but it is also undesirable from the standpoint of the utility company, inasmuch as these large reactive currents must be fed into the electrical lines over the utility company's electrical lines and distribution transformers and this too can be overheated. For example, in one test, two 40-watt rapid-start type lamps were removed from their sockets in the lamp fixtures and 38 volt-amperes were measured at the ballast input. This volt-ampere is lower than the normal level of 102 volt-amperes, but is larger than the desired reading of zero if the ballast input was disconnected from the power line. The reader may make reference to the literature concerning "power factor correction" and measures normally taken by the utility companies and others to eliminate reactive currents of this type from electrical distribution lines and maintain the power factor of the line current at approximately "1." Thus not only is the consumer deprived of desired light, but savings of electricity are not as great in practice as one might expect from that privation.

If the electrical connections to the ballast were disconnected from the power line, the problem of continued reactive current is avoided entirely. However to do so is a more difficult task than simply removing the fluorescent lamps from their sockets and also makes it more difficult to return those lamps to service.

SUMMARY OF THE INVENTIUON

It is thus an object of my invention to provide a power-reducing circuit as an attachment or modification to a two-lamp rapid-start lamp lighting system which reduces power consumption and illumination by a similar percentage. As further considered another object of my invention is to provide an inexpensive attachment for lamp systems of the rapid-start type which reduces power consumption in the lamp system by a predetermined percentage without requiring removal of any of the fluorescent lamp tubes.

Briefly stated, the invention includes a combination of an electrical capacitor and an isolation transformer with the capacitor connected between the primary and secondary of the isolation transformer. The two-lamp ballast for rapid-start type fluorescent lamps comprises the high leakage reactance transformer with a primary winding, a high voltage secondary winding, and three low voltage secondary windings for providing lamp filament current. In this the high voltage winding is connected in series with a capacitor and the capacitor is connected to the first filament secondary winding. A second capacitor is internally connected in series circuit between the first filament secondary and a second filament secondary winding and the remaining end of the secondary is connected to the third secondary winding. The foregoing elements are encapsulated within the ballast container and three pairs of leads associated with a corresponding one of the three filament secondaries extend therefrom. Each of the two lamps contains two filaments, one at each end of the lamp. The pair of leads from the third filament winding are connected in circuit with the filament of one of the lamps. The second pair of leads associated with the second filament secondary is connected in circuit with the remaining filament of the second lamp and one of the filaments of the first lamp.

The remaining pair of leads associated with the first filament secondary are connected in circuit with the primary winding of the isolation transformer and the secondary winding of the isolation transformer is connected in circuit with the remaining filament of the first lamp. Effectively the capacitor across the isolation transformer is placed in series circuit with the ballast capacitor and the lamps. By means of this arrangement the lamp current and power is reduced as well as the lamp illumination and the power factor of the lamp ballast system as described remained near 1.

Viewed as a method of modifying existing rapid-start type lamp systems of the aforedescribed type, one simply detaches the leads from the first filament secondary to the first lamp terminal, installs the isolation transformer capacitor combination, in which the capacitor is connected between the primary and secondary of that transformer, within the lamp fixture, and connects the detached leads in circuit with said primary and connects said lamp filament in circuit with said transformer secondary.

The foregoing structure and steps characteristic of my invention as well as the objects accomplished and advantages inherent in the invention is better understood by making reference to the detailed description of a preferred embodiment thereof which follows, considered together with the figures of the drawing.

DESCRIPTION OF THE PREFERRED EMBODIMENTS

Figure 1:
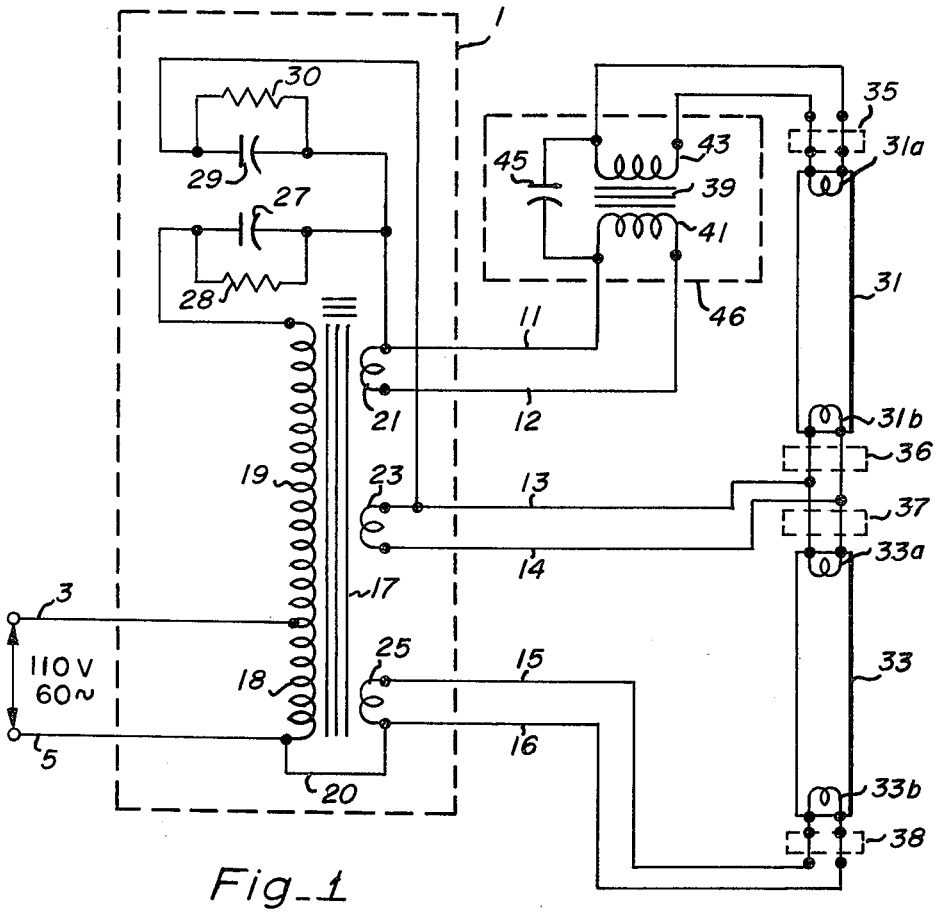
FIG. 1 illustrates schematically the attachment and a modified lamp lighting system of the invention.

In the preferred embodiment of FIG. 1, the combination of a conventional two-lamp ballast for starting and operating two rapid-start lamps is schematically illustrated. As is known to those skilled in the art, the ballast physically appears as a sealed elongated rectanguloid metal container, which I have symbolically represented by the dash lines 1, and a plurality of insulated electrical leads extend therefrom usually through openings in the container ends. These insulated electrical leads are designated 3, 5, 11, 12, 13, 14, 15 and 16 in the figure. Confined within the metal container is the electrical transformer 17, typically a high leakage reactance auto-transformer of conventional structure, which contains a core of magnetic material represented by three parallel lines, a primary winding 18, connected as illustrated to the power input leads 3 and 5, a high voltage secondary winding 19, connected electrically in auto-transformer relationship with the primary and magnetically in high leakage reactance relationship with the primary, and three additional secondary windings, commonly termed "filament windings," 21, 23, and 25. The windings are formed of electrically insulated wire containing a predetermined number of wire turns and in which the number of turns in the secondary 19 is significantly larger than those of the primary to define a "turns" ratio therebetween to provide a "step up" voltage relationship between secondary 19 and primary 18 and the turns in each of secondaries 21, 23, and 25, substantially identical to one another, is significantly less than the turns of the primary so as to define a "turns ratio" therebetween substantially less than 1 to provide a "step down" voltage relationship between primary 18 and each of secondaries 21, 23 and 25. A first capacitor 27 is connected electrically in series with one end of secondary 19 and secondary 21 and a resistor 28 of high value is connected in circuit across this capacitor. A second capacitor 29 is connected electrically in series between capacitor 27 (and secondary 21) and secondary 23, and a high value resistor 30 is connected in circuit across this capacitor. The foregoing elements as illustrated are enclosed within the metal container 1, and the metal container is impregnated with a "fill" material, such as asphalt, and sealed. As a practical matter, the aforedescribed elements within the metal container are inaccessible.

Conventional rapid-start type lamps found in presently existing lamp fixtures are operated in pairs from a single ballast, such as lamps 31 and 33 in FIG. 1. The lamps physically appear as long cylindrical glass tubes and contain a filament, sometimes termed a heater or cathode, at each end which are designated 31*a* and 31*b* for lamp 31, and 33*a* and 33*b* for lamp 33. As is familiar, the lamps have two electrical prongs or terminals extending from each end, with one prong connected to a corresponding end of the associated lamp filament. The lamp terminals are inserted into corresponding electrical sockets in an overhead lamp fixture, not illustrated, which physically supports the lamps and places the electrical connections thereto in the illustrated electrical circuit. For purposes of clarity I have illustrated symbolically four electrical sockets, 35, 36, 37 and 38, in the figure. Electrical leads 15 and 16 are in circuit with secondary filament winding 25, extend from the encapsulated ballast, and are connected electrically through the terminals of electrical socket 38 to the corresponding terminals of lamp filament 33*b*. Electrical leads 13 and 14 are in circuit with secondary filament winding 23, extend from the encapsulated ballast 1, and are connected through the terminals of electrical sockets 36 and 37 in electrical parallel circuit to the corresponding terminals of the lamp heaters 31*b* and 33*a*.

A small isolation transformer 39 is provided. The transformer has a magnetic core represented by three lines, a primary winding 41 and a secondary winding 43. The primary winding is formed of a predetermined number of turns of insulated electrical wire and the secondary is formed of at least twice the number of turns of insulated wire as the primary winding. This transformer construction suitably is of any core or shell type in which one of the windings is wound atop and insulated from the other of the windings in a single coil form, and the coil form is mounted on the magnetic iron core.

Electrical leads 11 and 12 are connected to the ends of secondary filament winding 21, extend from the encapsulated ballast 1, and are connected in circuit with secondary winding 41. Secondary winding 43 is connected through socket 35 in circuit with the heater 31*a* of lamp 31. A capacitor 45 is connected in circuit between winding 41 and winding 43.

In an existing ballast lamp combination, electrical leads 11 and 12 are connected to the two terminals of socket 35 so as to be placed directly in electrical connection with corresponding ends of filament 31*a*. In modifying that existing structure according to my invention the leads 11 and 12 are detached from socket 35 and are connected to the transformer 39 and to the capacitor 45 in the manner illustrated and previously described.

In the operation of this type of electrical circuit AC line voltage is applied across lines 3 and 5 and AC current flows through primary 18.

By conventional transformer action the primary AC voltage is stepped down to filament voltage level and this filament voltage appears across each of the secondary AC outputs from each of the heater windings 21, 23 and 25. At this low voltage level, AC current is supplied from secondary 23 to each of filaments 31*b* and 33*a;* and AC current is supplied over leads 15 and 16 to filament 33*b*. However the AC voltage across secondary winding 21 is connected by leads 11 and 12 to primary 41 of transformer 39. Transformer 39 is an isolation transformer which essentially transfers the AC across the primary 41 and provides an AC voltage across its secondary winding 43 of the same voltage level, but avoids a direct electrical circuit connection between the primary and secondary. Secondary 43 supplies current to filament 31*a* at the low AC voltage level. I have found that it is necessary to employ a turns ratio between the turns of secondary 43 and the turns of primary 41 of 2:1 in order to obtain the same filament voltage level from winding 43 as previously obtained from ballast 21 prior to the conversion. Initially it appeared that the aforecited turns ratio should be 1:1 but apparently circulating currents in the primary 41 reduced the voltage converted into secondary 43. Obviously if higher voltages are desired for the lamp filament 31*a* or if a similar problem is encountered in a specific system, the turns ratio can be increased further. In this way the lamp filaments are heated for a sufficient period of time as desired with rapid-start type lamps to make the enclosed cathode electronically emissive.

By conventional transformer action the voltage is stepped up in secondary 19 and applied through capacitors 27 and 29 in lead 7, first across lamp 33.

Additionally by auto-transformer action, the AC voltage applied to the primary 18 is stepped up to a higher voltage level which appears across secondary 19, typically on the order of 180 volts. In the conventional auto-type transformer, a higher voltage is obtained by adding together the voltages of the primary and secondary, thus the voltage which appears between lead 20 and the transformer end of capacitor 27 by design under no-load conditions would equal the sum of the line and secondary 19 voltage. This high voltage is applied through capacitor 27 to filament winding 21 and thereover lead 11 to one side of capacitor 45 through which it is passed to one terminal of lamp 31. This voltage is also applied from the filament at end of capacitor 27 in the encapsulated ballast, through capacitor 29 and over the internal electrical lead to lead 13 associated with filament winding 23, wherein it is directly coupled to each of the lamp terminals associated with filament 31*b* of lamp 31 and filament 33*a* of lamp 33. The remaining lead 20 is connected internally within ballast container 1 to one end of secondary winding 25 and is connected via lead 16 over to the filament 33*b* of lamp 33. Under no-load conditions neither of lamps 31 and 33 are conducting current. In this type of ballast arrangement it is apparent that the voltage initially appearing across lamp 31 is essentially zero since the voltage at capacitor 29 applied to lead 13 is essentially the same as the voltage appearing at the other side of that capacitor appearing at lead 11. However the full AC voltage is applied between terminals 33*a* and 33*b* of lamp 33. Considering the voltage at lead 20 to be the common or neutral point, the voltage applied to the other lamp terminal via lead 13 is in excess of that required to start operation of lamp 33. Once lamp 33 begins to conduct current it changes from a very high impedance device to a very low impedance device reducing the voltage thereacross to a low level. In so doing, the voltage level at lead 13 and hence at filaments 31*b* is reduced. Inasmuch as the voltage at terminal 31*a* remains at a high level the voltage difference across lamp 31 is by design now at a sufficiently high level to cause the lamp to start conducting. Once lamp 31 is conducting current, the supply of electrical current for powering lamps 31 and 33 follows an essential series circuit relationship with current flow from secondary 19 through capacitor 27 over lead 11, capacitor 45, filament 31*a*, through lamp 31 to filament 31*b*, through filament 33*a* of lamp 33 and through the lamp to filament 33*b* over lead 16 and lead 20 back to the secondary. Other more complex voltage and current relationships exist in this operating circuit which are known to those skilled in the art and other than the brief background information hereinbefore provided need not be discussed in further detail and the reader may make reference to such prior art materials and information. Basically the ballasts operate lamps 33 and 31 initially in sequence as described.

Ballast 1 is designed normally so that the high voltage output is higher than the starting voltage of an individual lamp, and when both lamps are in the operating condition and conducting AC current in series an average AC current, limited by the capacitive reactive impedance of the series capacitor, such as capacitor 27, be at the level specified as optimal by the lamp manufacturer to maximize illumination from series connected lamps, such as lamps 31 and 33. Concurrently, the series capacitance effectively combines with the leakage inductance of the transformer to provide a high power factor considered electrically at the input, lines 3 and 5, to the transformer and hence what appears electrically to the power lines in an almost "resistive" electrical load, one in which the capacitive reactance and the inductive reactance are almost equal in value.

The insertion of an additional capacitance, such as capacitor 45, in series with capacitor 27 encapsulated in the ballast, by means of my invention, reduces the effective series capacitance in the lamp operating circuit. Hence the effective series capacitive reactance is increased. The impedance of the lamp operating circuit, considered from one end of the secondary 19, capacitor 27, capacitor 45, lamp 31, lamp 33, back to the other side of the winding, is thus increased and this necessarily reduces the AC current flow through the lamps.

With reduced lamp current the lamp illumination intensity decreases accordingly. With reduced lamp current it is apparent that the current supplied into ballast 1 is likewise reduced, but inasmuch ass the transformer has both inductive and capacitive reactance the power factor remains essentially near the ideal ratio of 1 to avoid generally reactive line currents.

It is of course known in the prior art that if the designer of the ballast 1 were to decrease the capacitance of capacitor 27, the impedance of the operating circuit is thereby increased and the electrical AC current flowing through lamp 31 and 33 is reduced to that specified as optimum by the lamp manufacturer, and in so doing the ballast can be designed to accomplish the same purposes as the structure of my invention. However should such ballasts be poor it should be recognized that because all of the elements in the ballast container 1 are encapsulated in a hardenable asphalt material, such a change is permanent and cannot thereafter be modified should optimum lamp current thereafter be desired and as a practical matter it would require replacement of the complete ballast transformer. This is obviously expensive. Alternatively in connection with presently existing lamp fixtures containing properly designed ballast as heretofore mentioned, the elements of the ballast are permanently incased in the container in hardened asphaltic material and hence it is almost impossible to tear apart the ballast container to either change the capacitor 27 to a smaller value or to insert additional capacitance in series therewith so as to reduce the overall capacitance. This is obviously more difficult and obviously expensive, and again should a change in that way be made one is back to the first case wherein it is expensive to change again back to the original component values should specified lamp current be desired thereafter.

In one specific example of my invention, I have taken a ballast manufactured by Jefferson Electric Division of Bellwood, Illinois, Model No. 300-8701-700, designed to supply two lamps, Type R.S., 40 WT12 of 40 watts each. Prior to the modification the lamp load consumed 96 watts at the input of a power factor of 1.0 and provided an illumination intensity of 55 lumens, with line current at 0.8 amps and lamp current of 0.425 amps. In one example the capacitor 45 was a nonpolar type of 20 microfarads, with a 120 volt rating. Transformer 39 consisted of a E-I type iron core of approximately 1.375 square inches in cross section, winding 41 comprised 76 turns of No. 28 insulated wire, and winding 43 comprised 152 turns of No. 28 insulated wire. Subsequent to the modification the current through the lamps was reduced to 0.352 ($I_o$) and the line current was reduced to 0.698 amps, and the illumination intensity dropped to 48.5 lumens, and the power consumption of the lamp system as measured at leads 3 and 5 was reduced to 81 watts with a power factor of 0.967. Thus the illumination intensity was reduced by 12 percent with a reduction in input power of 15.6 percent so that the decrease in illumination percentagewise was less than the percentage savings in power consumption. By the foregoing means it is apparent that what occurs is that users employing this modified lighting system for the attachment combined in accordance with my invention need not deprive themselves of as much light which they currently are doing through use of the simple expedient of removing fluorescent tubes from certain ones of the fixtures while at the same time they are conserving essentially as much electrical power as before.

Figure 2:
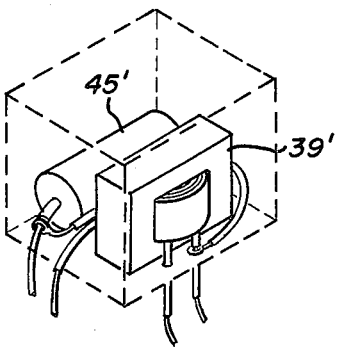
FIG. 2 illustrates a mechanical perspective of the transformer and capacitor attachment.

As illustrated in FIG. 2 the transformer is of relatively small physical dimensions of 1.375 × 1.750 × 1.00 inches and capacitor 45 is of approximately 1,4375 × 2.625 inches which takes very little space. These elements may be conveniently wired together into the single unit as illustrated and attached within the lighting fixture by screws. The electrical leads can conventionally be connected to the existing leads through the means of the solderless connectors widely used in electrical appliances and may be easily installed. The units transformer and capacitor are relatively inexpensive and are thought to more than justify the benefits obtained through their use.

It is believed that the foregoing detailed description of a preferred embodiment of my invention is sufficient in detail to enable one skilled in the art to make and use same. It is expressly understood however that my invention is not to be limited to the details described in connection with that preferred embodiment presented for the foregoing purpose, but is to be broadly construed to include the full range of equivalents, substitutions as well as the improvements which become apparent to one skilled in the art upon reading this specification. It is thus requested that my invention be broadly construed within the full spirit and scope of the appended claims.

What I claim is:

1. In combination, an attachment for reducing illumination and power consumption in a rapid-start type fluorescent lamp lighting system of the type having an encased relatively inaccessible ballast transformer and capacitor combination with a pair of electrical leads extending therefrom connected within the case to a low voltage filament secondary winding on said encased transformer and a pair of series connected fluorescent lamps each of which has a lamp filament winding at each end, and in which said capacitor is connected inside the casing in circuit betwen an end of the high voltage secondary windings of said transformer and one of said leads, comprising in combination with said ballast and lamps:

an isolation transformer, said transformer having a primary winding, a secondary winding, each of said primary windings comprising a first and second predetermined number of turns of electrically insulated wire, respectively, and said windings being DC isolated from one another;

an electrical capacitor, said capacitor having first and second leads and said first lead connected to said secondary winding of said isolation transformer and said second lead connected in circuit to said primary winding of said isolation transformer for decreasing the electrical capacitance in series circuit with said lamp;

means for connecting said secondary winding of said isolation transformer in circuit with a one of the lamp filament windings at the end of said series connected lamps for supplying low AC voltage from said secondary to said filament windings; and means for connecting said primary winding of said isolation transformer in circuit with the leads to said filament secondary winding of said ballast transformer for supplying low AC voltage to said primary.

2. The invention as defined in claim 1 wherein the ratio of turns in said secondary winding to that of said primary winding in said isolation transformer is 2:1.

3. The invention as defined in claim 1 wherein said first lead is connected to one winding end of said secondary winding of said isolation transformer and wherein said second lead is connected to one winding end of said primary winding of said isolation transformer.

4. The invention as defined in claim 2 wherein said first lead is connected to one winding end of said secondary winding of said isolation transformer and wherein said second lead is connected to one winding end of said primary winding of said isolation transformer.

5. In combination with a ballast and fluorescent lamp illumination system of the type in which said ballast comprises in a sealed metal container:

a high leakage reactance transformer having a primary winding, a high voltage secondary winding coupled in autotransformer relationship, and first, second, and third low voltage secondary windings;

first capacitor means connected electrically in series between said auto-transformer and said first low voltage secondary winding;

a second capacitor connected electrically in series between said first low voltage secondary winding and said second low voltage secondary winding;

electrical lead means connecting said primary winding and said third filament winding;

first pair of insulated electrical leads extending into said metal container and connected electrically to respective ends of said primary windings for connection to a source of AC power;

three pairs of insulated electrical leads extending from said metal container with said pairs connected operatively in circuit with a respective one of said filament windings; and wherein said fluorescent lamps are of the rapid-start type in which each lamp includes a filament winding at each end of and within an elongated tubular glass envelope and a pair of electrical terminals connected in circuit with an associated lamp filament winding extending from said lamp; and wherein said pair of electrical leads coupled to said third filament secondary winding are connected in circuit with one filament of one lamp; and wherein said pair of electrical leads coupled to said second secondary are connected in circuit with the other filament of said second lamp and a one of the filaments of said first lamp;

the invention comprising in combination therewith:

a second transformer having a primary winding and a secondary winding, said secondary winding being directly electrically isolated from said primary winding;

capacitor means, said capacitor means connected in circuit between said primary and said secondary to establish a capacitively reactive impedance therebetween whereby said capacitor means is effectively placed to series circuit with said first capacitor means and said lamps to increase the overall capacitive reactance of such series circuit;

means connecting said electrical leads from said first low voltage secondary winding in circuit with said primary of said second transformer for supplying a low voltage thereto; and electrical lead means connecting said secondary winding of said second transformer in circuit with said remaining lamp filament of said first lamp for supplying filament voltage to said lamp filament.

6. The invention as defined in claim 5 wherein said secondary winding of said second transformer contains a first predetermined number of turns of wire, $N_s$, and said primary winding of said second transformer contains a second predetermined number of wire turns, $N_p$, and wherein the ratio of $N_s$ to $N_p$ is equal to 2:1.

7. The method of reducing power consumption and illumination from a pair of series operated fluorescent type rapid-start lamps, in a ballast and fluorescent lamp combination in which a first pair of electrical leads extends from said ballast and is connected in circuit with a first lamp filament of a first lamp and in which a high AC voltage is applied through a capacitor to said leads within said ballast, a second pair of electrical leads extends from said ballast and is connected in circuit with the remaining filament of said first lamp and with the first filament of a second lamp, and in which a third pair of electrical leads extends from said ballast and is connected in circuit with the remaining filament of said second lamp, comprising the steps of:

removing said first pair of leads from said circuit connection with said first filament of said first lamp;

installing an isolation transformer and capacitor combination within the lamp fixture, said transformer and capacitor combination comprising a transformer having a primary winding and a secondary winding, said windings being DC isolated from one another, and said capacitor being connected in circuit between said primary and said secondary winding; and connecting said secondary winding in circuit with said first filament of said first lamp and connecting said primary winding in circuit with said first pair of electrical leads.

* * * * *